US006773518B2

(12) United States Patent
Yoon et al.

(10) Patent No.: US 6,773,518 B2
(45) Date of Patent: Aug. 10, 2004

(54) COLD ROLLED STEEL SHEET HAVING EXCELLENT CORROSION RESISTANCE TO SULFURIC ACID

(75) Inventors: Jeong-Bong Yoon, Pohaing-Si (KR); Ki-Ho Kim, Pohang-si (KR)

(73) Assignee: Pohang Iron & Steel Co., Ltd. (KR)

( * ) Notice: Subject to any disclaimer, the term of this patent is extended or adjusted under 35 U.S.C. 154(b) by 93 days.

(21) Appl. No.: 10/048,857

(22) PCT Filed: Jun. 5, 2001

(86) PCT No.: PCT/KR01/00955

§ 371 (c)(1),
(2), (4) Date: Feb. 4, 2002

(87) PCT Pub. No.: WO01/94654

PCT Pub. Date: Dec. 13, 2001

(65) Prior Publication Data

US 2002/0148538 A1 Oct. 17, 2002

(30) Foreign Application Priority Data

Jun. 5, 2000 (KR) ..... 2000-30722

(51) Int. Cl.[7] ..... C22C 38/10; C22C 38/16; C22C 38/06

(52) U.S. Cl. ..... 148/332

(58) Field of Search ..... 148/332; 420/89

(56) References Cited

U.S. PATENT DOCUMENTS 4,407,681 A * 10/1983 Ina et al. ..... 148/330

FOREIGN PATENT DOCUMENTS

| | | |
|---|---|---|
| JP | 08-294793 A | 11/1996 |
| JP | 09-025536 A | 1/1997 |
| JP | 09-210260 A | 8/1997 |
| JP | 10-060601 A | 3/1998 |
| JP | 10-110237 A | 4/1998 |
| JP | 10-212546 A | 8/1998 |

* cited by examiner

*Primary Examiner*—Deborah Yee
(74) *Attorney, Agent, or Firm*—Webb Ziesenheim Logsdon Orkin & Hanson, P.C.

(57) ABSTRACT

A cold rolled steel sheet which has an excellent corrosion resistance to sulfuric acid, the steel includes in weight %: 0.15% or less of C, 1.0% or less of Si, 0.2~1.5% of Mn, 0.03% or less of S, 0.03% or less of P, 0.01~0.1% of Al, 0.2~1.0% of Cu, 0.02~0.2% of Co, and a balance of Fe and other unavoidable impurities.

1 Claim, No Drawings

COLD ROLLED STEEL SHEET HAVING EXCELLENT CORROSION RESISTANCE TO SULFURIC ACID

FIELD OF THE INVENTION

The present invention relates to a cold rolled steel sheet which has excellent corrosion resistance to sulfuric acid. More specifically, the present invention relates to a cold rolled steel sheet having excellent corrosion resistance to sulfuric acid, which is used as the material of the components exposed to sulfuric acid, such as the pre-heater of a thermoelectric power plant, boiler components and the like.

BACKGROUND OF THE INVENTION

Generally, it is known that a large amount of Cu is added in a sulfuric acid corrosion resistant steel so that corrosion of the sulfuric-acid-resistant steel can be slowed down under sulfuric acid atmosphere. However, although Cu is superior in slowing down sulfuric acid corrosion compared with other additives, if too much is added, problems occur, such as the generation of cracks and the like during hot rolling.

Japanese Patent Application Laid-open No Hei-9-25536 discloses an acid-corrosion resistant steel which aims at solving the above described problem. This steel includes in weight %: 0.01~0.15% of C, 0.1~0.5% of Si, 0.1~0.5% of Mn, 0.03% or less of P, 0.01% or less of S, 0.2~1.0% of Cu, 0.5% or less of Ni, 2.0% or less of Cr, 0.1% or less of Al, 0.01~1.0% of Sn and/or Sb, 0.005% or less of B, 0.2% or less of V, Nb: 0.2% or less of Nb, and 0.02% or less of Ti.

Another example is Japanese Patent Application Laid-open No Hei-10-110237 which includes in weight %: 0.01~0.15% of C, 0.1~0.5% of Si, 0.1~0.5% of Mn, 0.03% or less of P, 0.005% or less of S, 0.2~1.0% of Cu, 0.5% or less of Ni, 2.0% or less of Cr, 0.1% or less of Al, 0.2% or less of V, 0.2% or less of Nb, 0.2% or less of Ti, one selected from among 0.01~1.0% of Sn and/or Sb, 0.001~0.01% of B, and 0.01~0.5% of Mo, and a balance of Fe and other unavoidable impurities.

That is, in the above described invention, a proper amount of Cu is added and at the same time, other elements are compositely added. Thus a superior acid-corrosion resistance is aimed to be achieved, but at a low temperature and a low sulfuric acid concentration, the corrosion rate is still high, this being the problem.

SUMMARY OF THE INVENTION

In order to solve the above described problems, the present inventors carried out research and experiments repeatedly, and the result is the present invention.

Therefore it is an object of the present invention to provide a cold rolled steel sheet with an excellent sulfuric acid corrosion resistance, in which not only Cu but also a proper amount of Co is added so that the corrosion rate can be greatly lowered at a low temperature—low sulfuric acid concentration, thereby providing a cold rolled steel having a superior corrosion resistance against sulfuric acid.

In achieving the above object, the cold rolled steel sheet with an excellent sulfuric acid corrosion resistance according to the present invention includes in weight %: 0.15% or less of C, 1.0% or less of Si, 0.2~1.5% of Mn, 0.03% or less of S, 0.03% or less of P, 0.01~0.1% of Al, 0.2~1.0% of Cu, 0.02~0.2% of Co, and a balance of Fe and other unavoidable impurities.

DETAILED DESCRIPTION OF THE PREFERRED EMBODIMENT

Now the present invention will be described in detail.

The cold rolled steel sheet with an excellent sulfuric acid corrosion resistance according to the present invention includes in weight %: 0.15% or less of C, 1.0% or less of Si, 0.2~1.5% of Mn, 0.03% or less of S, 0.03% or less of P, 0.01~0.1% of Al, 0.2~1.0% of Cu, 0.02~0.2% of Co, and a balance of Fe and other unavoidable impurities.

If the content of C exceeds 0.15%, the weldability is severely lowered, and therefore, defects are liable to occur. Accordingly, the content of C should be preferably limited to 0.15% or less.

The element Si is added mainly to improve the strength of the steel, but if its content exceeds 1.0%, then the corrosion resistance is greatly aggravated at the low temperature-low sulfuric acid concentration. Accordingly, the content of Si should be preferably limited to 1.0% or less.

The element Mn is usually added to prevent hot shortness caused by solid solute sulfur which has been precipitated in a form of manganese sulfide. In the present invention, Mn is added not only for preventing hot shortness, but also to improve the strength of the steel.

In the present invention, the content of Mn should be preferably limited to 0.2~1.5%. The reason is as follows. That is, if the content of n exceeds 1.5%, then not only the strength improvement effect is lowered, but also the sulfuric acid corrosion resistance is slightly aggravated. On the other hand, if the content of Mn is less than 0.2%, the hot shortness is likely to occur.

The content of S should be preferably as low as possible in the present invention. If its content exceeds 0.03%, then defects are liable to occur due to hot rolling brittleness, and therefore, its upper limit should be preferably set to 0.03%.

The content of P should also be preferably as low as possible. If its content exceeds 0.03%, the corrosion resistance is greatly lowered, and therefore its upper limit should be preferably limited to 0.03%.

The element Al is added as a deoxidizing agent. If its content is less than 0.01%, then the deoxidizing effect is too meager, while if its content exceeds 0.1%, then surface defects are apt to occur due to an increase of Al oxides. Accordingly, the content of Al should preferably limited to 0.01%–0.1%

The element Cu is added for improving the sulfuric acid corrosion resistance. However, its effects are significantly lowered only if its content is below 0.2%. However, if its content exceeds 1.0%, the additional effects are negligible compared with the added amount. Accordingly the content of Cu should be preferably limited to 0.2–1.0%.

The addition of Co is the characteristic feature of the present invention, and Co greatly improves the corrosion resistance at the low temperature-low sulfuric acid concentration.

In the present invention, the content of Co should be preferably limited to 0.02~0.2%, and the reason is as follows. That is, if the content of Co is less than 0.02%, then its addition effects are too negligible, while if its content exceeds 0.2%, the improvement of the corrosion resistance is not sufficient in view of the addition amount.

If the economy is taken into account, the content of Co should be more preferably limited to 0.02~0.15%.

Further, in the present invention, the contents of Cu and Co have to be respectively controlled, and the atomic ratio of Cu/Co also has to be properly controlled, so that a superior corrosion resistance can be ensured. That is, the atomic ratio of Cu/Co should be preferably limited to 2.0 or more. If the mentioned atomic ratio is less than 2.0, then the elution of Cu within the steel is decreased, with the result that the corrosion resistance is aggravated.

Meanwhile, the steel which is composed as described above is hot-rolled and cold-rolled, and then a continuous annealing or a batch annealing is carried out by maintaining the steel above the recrystallization temperature for 10 seconds or more, thereby obtaining a cold rolled steel sheet with a superior corrosion resistance.

Now the present invention will be described based on an actual example.

EXAMPLE

Steel ingots having the compositions of Table 1 below were prepared.

Then all the ingots were maintained at a temperature of 1250° C. for 1 hour, and then a hot rolling was carried out. Under this condition, the hot finish rolling was started at 1100° C., the coiling temperature was 650° C., and the final thickness was 4.5 mm.

Then the hot rolled test pieces were pickled so as to remove the surface oxide films, and then a 73%-cold-rolling was carried out down to a final thickness of 1.2 mm. Then a degreasing and a continuous annealing were carried out. Under this condition, the continuous annealing was carried out at a temperature of 830° C. for 30 seconds.

Then, for these annealed test pieces, the sulfuric acid corrosion resistance at the low temperature-low concentration conditions was measured in the following manner. That is, the test pieces were immersed in a 50%-sulfuric acid solution at a temperature of 70° C. for one hour, and then, the corrosion losses were measured, and the measured results are shown in Table 1 below.

TABLE 1

| | Chemical composition (Weight %) | | | | | | | | Cu/Co Atomic | Corrosion loss |
|---|---|---|---|---|---|---|---|---|---|---|
| Classfctn | C | Si | Mn | P | S | Al | Cu | Co | ratio | ($mg/cm^2 \cdot hr$) |
| Invntv steel 1 | 0.08 | 0.1 | 0.5 | 0.01 | 0.02 | 0.04 | 0.35 | 0.06 | 5.41 | 5.3 |
| Invntv 2 | 0.084 | 0.1 | 0.8 | 0.009 | 0.023 | 0.05 | 0.25 | 0.1 | 2.32 | 5.9 |
| Invntv 3 | 0.078 | 0.08 | 1.0 | 0.015 | 0.03 | 0.045 | 0.38 | 0.08 | 4.4 | 5.4 |
| Invntv 4 | 0.081 | 0.09 | 0.3 | 0.012 | 0.018 | 0.035 | 0.40 | 0.15 | 2.47 | 4.9 |
| Invntv 5 | 0.080 | 0.2 | 0.8 | 0.020 | 0.018 | 0.035 | 0.28 | 0.15 | 1.73 | 10.8 |
| Invntv 6 | 0.075 | 0.14 | 0.82 | 0.018 | 0.015 | 0.032 | 0.22 | 0.18 | 1.13 | 12.5 |
| Invntv 7 | 0.083 | 0.18 | 1.2 | 0.012 | 0.021 | 0.042 | 0.30 | 0.18 | 1.54 | 8.8 |
| Cmprtv steel 1 | 0.080 | 0.1 | 0.5 | 0.010 | 0.012 | 0.04 | 0.15 | 0 | — | 58.6 |
| Cmprtv 2 | 0.085 | 0.12 | 0.8 | 0.082 | 0.01 | 0.038 | 0.35 | 0.08 | 4.06 | 62.5 |
| Cmprtv 3 | 0.081 | 0.5 | 1.5 | 0.025 | 0.015 | 0.042 | 0.25 | 0 | — | 35.2 |
| Cmprtv 4 | 0.079 | 0.15 | 1.0 | 0.02 | 0.02 | 0.04 | 0.20 | 0 | — | 24.5 |
| Cmprtv 5 | 0.075 | 0.15 | 0.92 | 0.025 | 0.016 | 0.035 | 0.26 | 0.004 | 60.25 | 23.5 |

As shown in Table 1 above, in all the cases of the inventive steels (1~7) in which not only Cu but also a proper amount of Co were added, there were shown low corrosion losses, thereby proving the superior sulfuric acid corrosion resistance. Particularly, not only the contents of Cu and Co are appropriated, but also the atomic ratio of Cu/Co was controlled to 2 or more in the inventive steels (1~4), and therefore, these cases showed very low corrosion losses as low as 6.0 $mg/cm^2 \cdot hr$, thereby proving the superior sulfuric acid corrosion resistance.

On the other hand, in the cases of the comparative steels (1~5) in which the chemical compositions departed from the range of the present invention, there were shown very much higher corrosion losses compared with the inventive steels as shown in Table 1.

According to the present invention as described above, the sulfuric acid corrosion resistance is very much improved, and therefore, the life expectancy can be greatly improved in the pre-heaters of thermoelectric power plants (in which the dew point corrosion occurs), in the pipes of boilers and the like.

What is claimed is:

1. A cold rolled steel sheet having excellent sulfuric acid corrosion resistance, comprising in weight %: 0.15 or less of C, 1.0% or less of Si, 0.2–1.5% of Mn, 0.03% or less of S, 0.03% or less of P, 0.01–0.1% of Al, 0.2–1.0% of Cu, 0.02–0.2% of Co, and a balance of Fe and other unavoidable impurities, and wherein the atomic ratio of Cu/Co is at least 2.0.

* * * * *

UNITED STATES PATENT AND TRADEMARK OFFICE

CERTIFICATE OF CORRECTION

PATENT NO. : 6,773,518 B2
DATED : August 10, 2004
INVENTOR(S) : Yoon et al.

It is certified that error appears in the above-identified patent and that said Letters Patent is hereby corrected as shown below:

Column 2,
Line 54, "should preferably" should read -- should be preferably --

Signed and Sealed this

Twenty-second Day of February, 2005

JON W. DUDAS
*Director of the United States Patent and Trademark Office*